US007448442B2

(12) United States Patent
Wells

(10) Patent No.: US 7,448,442 B2
(45) Date of Patent: Nov. 11, 2008

(54) PAD TYPE PLUNGER

(75) Inventor: Edward A. Wells, Corpus Christi, TX (US)

(73) Assignee: MGM Well Service, Inc., Corpus Christi, TX (US)

( * ) Notice: Subject to any disclaimer, the term of this patent is extended or adjusted under 35 U.S.C. 154(b) by 36 days.

(21) Appl. No.: 11/434,740

(22) Filed: May 16, 2006

(65) Prior Publication Data

US 2007/0267189 A1 Nov. 22, 2007

(51) Int. Cl.
*E21B 43/16* (2006.01)
*E21B 33/10* (2006.01)

(52) U.S. Cl. ..... 166/68; 166/153; 166/372; 417/56

(58) Field of Classification Search ..... 166/153, 166/155, 68, 372; 417/56, 59
See application file for complete search history.

(56) References Cited

U.S. PATENT DOCUMENTS

| | | | | |
|---|---|---|---|---|
| 2,001,012 | A | 5/1935 | Burgher | |
| 2,674,951 | A * | 4/1954 | Zaba | 417/59 |
| 3,304,874 | A * | 2/1967 | Lyles | 417/59 |
| 4,531,891 | A * | 7/1985 | Coles, III | 417/59 |
| 4,923,372 | A * | 5/1990 | Ferguson et al. | 417/53 |
| 6,045,335 | A | 4/2000 | Dinning | |
| 6,209,637 | B1 | 4/2001 | Wells | |
| 6,467,541 | B1 | 10/2002 | Wells | |
| 6,591,737 | B2 | 7/2003 | Giacomino | |
| 6,644,399 | B2 | 11/2003 | Abbott | |
| 6,669,449 | B2 | 12/2003 | Giacomino | |
| 6,719,060 | B1 | 4/2004 | Wells | |
| 6,746,213 | B2 | 6/2004 | Giacomino | |
| 7,093,652 | B2 * | 8/2006 | Gray et al. | 166/106 |
| 2006/0144597 | A1 | 7/2006 | Casey | |

* cited by examiner

*Primary Examiner*—Shane Bomar
(74) *Attorney, Agent, or Firm*—G. Turner Moller

(57) ABSTRACT

A plunger lift for a hydrocarbon well includes a piston that is dropped into the well and then moved upwardly to lift liquid to the surface from adjacent a hydrocarbon formation. The piston includes a series of pads biased outwardly into engagement with an inside wall of the production string thereby providing an improved seal between the piston and the production string. The pads are biased outwardly by pressure from below or a pressure differential that is moving the piston upwardly. The force moving the pads outwardly are greater during upward movement of the piston than during downward movement. The piston includes a central one-piece mandrel having an upper end higher than any component of the piston and a lower end lower than any component of the piston so that impact forces are applied directly to the mandrel and not through a threaded component.

11 Claims, 4 Drawing Sheets

42
44
74
38
52
68
92
82
78
56
76
62
66
66
63
60
58
48
54
50
46

106

104
100
126
110
122
122
124
124
120
116
114
120
112
108
102

PAD TYPE PLUNGER

This invention relates to a plunger lift and more particularly to a pad type plunger for moving liquids upwardly in a hydrocarbon well and more specifically to an improved technique for sealing between the exterior of the plunger and the inside of the production string.

BACKGROUND OF THE INVENTION

Because of the improvements provided by two piece plungers, plunger lifts have become considerably more common in hydrocarbon wells, particularly in lifting water and condensate from gas wells. A fast growing segment of artificial lift equipment is the use of plungers that lift sufficient liquids to keep otherwise marginal gas wells producing. Of course, high oil and gas prices contribute to the desire to keep older wells producing and two piece plunger lift systems have been effective in this regard. Typical two piece plunger lift systems are shown in U.S. Pat. Nos. 2,001,012 and 6,467,541.

Gas wells reach their economic limit for a variety of reasons. A common reason is that gas production declines to a point where the formation liquids are not readily moved up the production string to the surface. Two phase upward flow in a well is a complicated affair and most engineering equations thought to predict two phase flow are only rough estimates of what is actually occurring. A major reason is the changing relation of the liquid and of the gas flowing upwardly in the well. At times of more-or-less constant flow, the liquid acts as a upwardly moving film on the inside of the flow string while the gas flows in a central path on the inside of the liquid film. The gas flows much faster than the liquid film. When the volume of gas flow slows down below some critical value, or momentarily stops, liquid runs down the inside of the flow string and accumulates in the bottom of the well, often in sufficient quantity to reduce or stop flow from the formation into the well. If flow stops, the well has to be swabbed, at considerable expense, to bring it back on production.

One of the areas of plunger lifts, both of the one piece and two piece types, that needs improvement is the seal that operates between the piston and the inside of the production string. It will be immediately appreciated that if the plunger is successful in bringing up more liquid on each trip and leaving less liquid in the production string, results will improve. The production string of most wells comprises threaded pipe joints, typically 2⅜" O.D. or 2⅞" O.D., although smaller and larger sizes are known. The inside surface of such production strings is not a perfect cylinder for a variety of reasons. First, there is a gap in the coupling of all threaded production strings where liquid collects and is bypassed by the plunger or piston. Second, no production string has a perfect inside surface when new and, manifestly, much used tubing with all its imperfections is run in new shallow wells. Third, during use there is sometimes a buildup of minerals on the inside surface. Fourth, corrosion can cause buildup on the inside surface or erosion of the inside surface, depending on the type of corrosion. Fifth, there are other mechanisms at work to erode the inside surface, such as high volume sand-laden production when a well is being cleaned up after a frac job. Sixth, production pipe can become egg shaped because of handling or mishandling during transportation or when being run into a well. For these and other reasons, experience has shown that one cannot use a non-pad type plunger of more than about 1.890-1.900" diameter in a nominally 1.995" I.D. pipe, which is the standard nominal internal diameter of 2⅜" tubing. Attempting to use a larger diameter plunger creates too great a risk of sticking the plunger in the production string. Similar caution is necessary in production strings of other sizes.

In response to these clearance problems, plungers are typically made significantly smaller than the nominal I.D. of the production string and rely on an exterior sealing structure to minimize bypass of gas and liquid around the outside of the plunger. There are a wide variety of prior art seal structures, including grooves on the exterior of the plunger causing turbulent zones reducing bypass around the exterior of the piston, whisker type seals incorporating a multiplicity of bristles that reduce bypass around the exterior of the piston, pad type devices which expand under spring forces to abut the inside of the production string, and the like. This invention most nearly relates to the pad type seals of plungers used to lift liquids in hydrocarbon wells. Prior art pad type plungers include a spring that provides all, or almost all, of the force biasing the pad into engagement with the inside of the production string. Disclosures of some interest relative to this invention are found in U.S. Pat. Nos. 6,045,335; 6,591,737; 6,644,399; 6,746,213 and 6,669,449.

SUMMARY OF THE INVENTION

In this invention, an improved pad type plunger is moved upwardly in a hydrocarbon well to lift liquids inside a production string under the impetus of a pressure differential across the plunger. In other words, the plunger is moved upwardly in the production string by formation products produced from one or more hydrocarbon formations communicating with the inside of the production string. The plunger comprises a restriction in the production string so, when the plunger is moving upwardly, the pressure below the plunger is greater than above the plunger. A pressure differential of a few pounds per square inch is sufficient to move a plunger upwardly although the exact pressure differential depends on the weight of the plunger, the weight of the column of liquid being lifted and other factors.

The plunger of this invention comprises a mandrel or body having one or more rigid pads on the exterior that are biased outwardly into engagement with the inner surface of a production string by the pressure differential that drives the plunger upwardly. The pads provide a seal of increased effectiveness to more efficiently lift liquids in the production string. The word "seal" is used even though it is somewhat of a misnomer because the real purpose of the seal is to reduce or control, rather than prevent, the amount of liquid and gas bypassing around the plunger. Several embodiments of this invention are disclosed, including a two piece plunger, a one piece plunger, and a spring assisted pad.

It is an object of this invention to provide an improved pad type plunger used to lift liquids in hydrocarbon wells.

A more specific object of this invention is to provide pad seals for a plunger which are outwardly biased by a pressure differential across the plunger.

A further object of this invention is to provide an improved pad type plunger which incorporates a one-piece mandrel in which impact forces are applied directly to the mandrel.

These and other objects of this invention will become more fully apparent as this description proceeds, reference being made to the accompanying drawings and appended claims.

DETAILED DESCRIPTION

Figure 1:
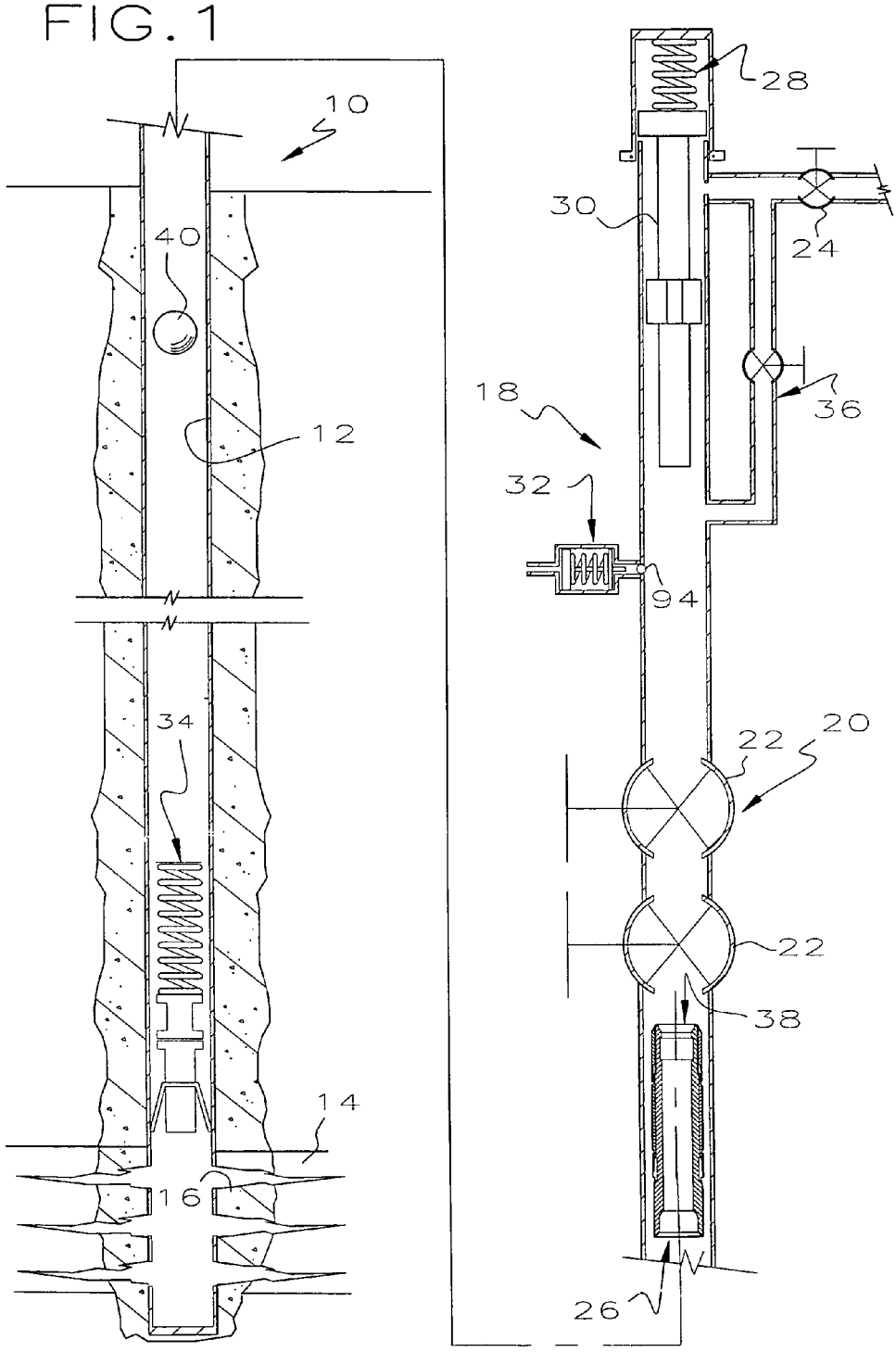
FIG. 1 is a schematic view of a plunger lift system for lifting liquids from a well.
Figure 2:
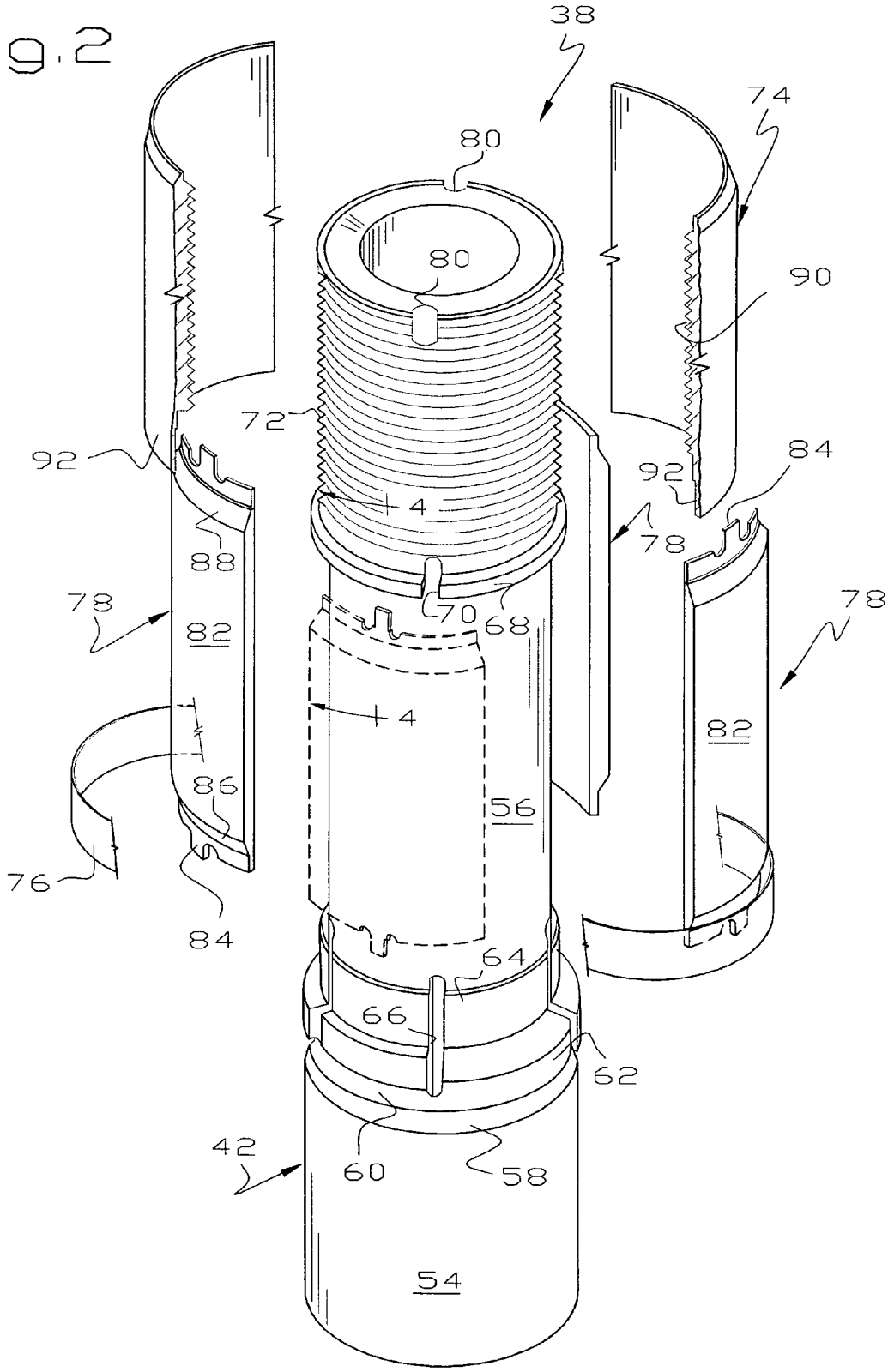
FIG. 2 is an exploded isometric view of a plunger of this invention.
Figure 3:
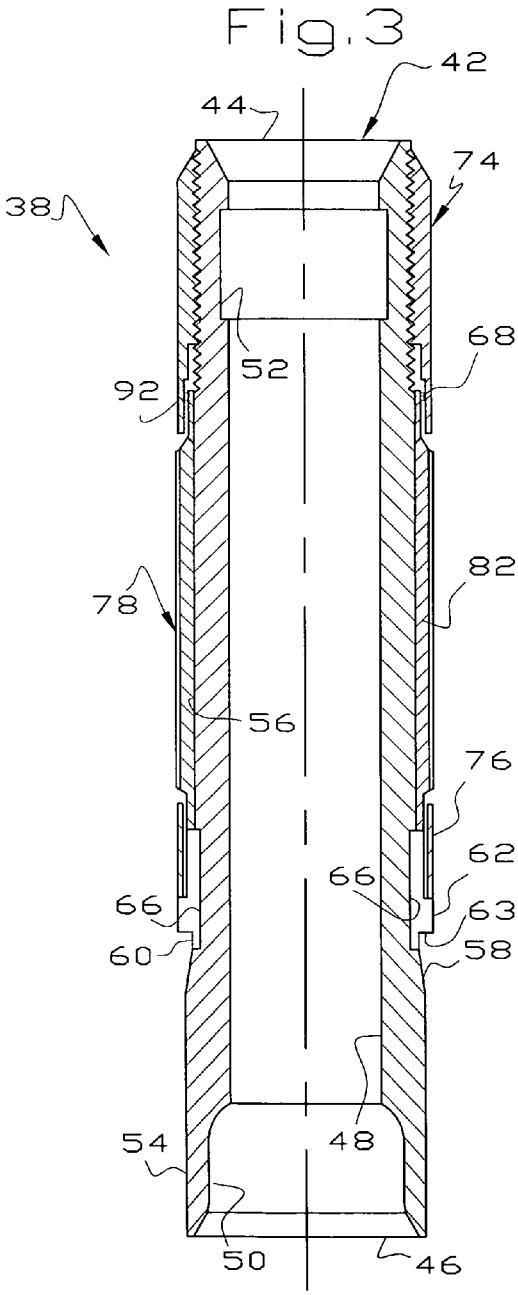
FIG. 3 is a vertical cross-sectional view of the plunger of FIG. 2.

Referring to FIGS. 1-4, a hydrocarbon well 10 comprises a production string 12 extending into the earth in communication with a subterranean hydrocarbon bearing formation 14. The production string 12 is typically a conventional tubing string made up of joints of tubing that are threaded together. Although the production string 12 may be inside a casing string (not shown), it is illustrated as cemented in the earth. The formation 14 communicates with the inside of the production string 12 through perforations 16. A plunger lift 18 may be used to lift oil, condensate or water from the bottom of the well 10 which may be classified as either an oil well or a gas well.

In a typical application of this invention, the well 10 is a gas well that produces some formation liquid. In an earlier stage of the productive life of the well 10, there is sufficient gas being produced to deliver the formation liquids to the surface without artificial lift equipment. The well 10 is equipped with a conventional well head assembly 20 comprising a pair of master valves 22 and a wing valve 24 delivering produced formation products to a surface facility for separating, measuring and treating the produced products.

The plunger lift system 18 of this invention comprises, as major components, a free piston or plunger 26, an upper bumper 28, a decoupler 30, a catcher assembly 32, a lower bumper 34 and a bypass 36 around the piston 26 when it is in its uppermost position in the well head assembly 20.

As shown in FIGS. 1-4, the piston 26 is illustrated as being of the multipiece type comprising an upper section or sleeve 38 and a lower section or ball 40. The sleeve 38 comprises a one-piece mandrel or body 42 having an upper end 44 higher than any other component of the sleeve 38 and a lower end 46 lower than any other component of the sleeve 38. All plungers have to be robust because they alternately slam into the upper bumper 28 and then into the lower bumper 34. By making the mandrel 42 of one-piece so that all impacts strike the mandrel 42, as opposed to striking some threadably attached component, the sleeve 38 becomes more robust and capable of longer periods of use.

Because the plunger 26 is of the multiple piece type, a passage 48 extends through the sleeve 38 and provides a compartment 50 for the ball 40 at the lower end thereof. The upper end of the sleeve 38 includes an interior fishing shoulder 52 to allow an inside grab device to fish the sleeve 38 from the well 10 in the event the sleeve 38 becomes stuck in the well 10.

The mandrel 42 provides a lower, generally cylindrical section 54 providing a nearly maximum diameter of the sleeve 38 and a central section 56 of minimum diameter. Above the lower section 54 is an inwardly tapered section 58 and a groove 60 above which is a rim 62 providing a maximum diameter for the sleeve 38. The transition between the maximum diameter rim 62 and the minimum diameter central section 56 is provided by a shoulder 63. A series of slots 66 extend between the groove 60 and an intermediate portion of the central section 56 to provide a passage for formation products for purposes more fully apparent hereinafter.

The pressure differential moving the plunger 26, i.e. the ball 40 and sleeve 38, upwardly is the difference between the pressure immediately below the shoulder 63 and the pressure immediately above the plunger 26. The pressure differential moving the pads 78 outwardly is the difference between the pressure immediately below the shoulder 63 and the pressure immediately above the plunger 26, i.e. the pressure differentials moving the plunger and moving the pads are essentially the same. An important but not apparent detail of the sleeve 38 is that the rim 62 is slightly larger in diameter than the lower section 54. The purpose is so the maximum pressure differential across the plunger 26 also acts on the pads 78 tending to bias them outwardly into engagement with the production string 12. In addition, the rim 62 is the same diameter as the nut 74. The outer diameter of the pads 78, when assembled, is smaller than the diameter of the rim 62 with the pads 78 retracted but larger than the diameter of the rim 62 with the pads 78 extended into engagement with the interior of the production string 12.

Figure 4:
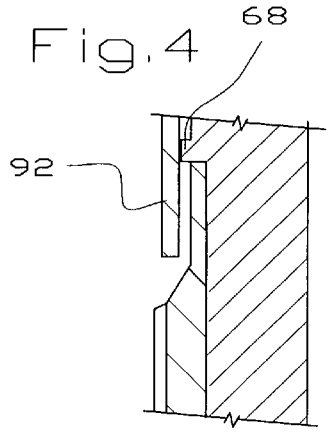
FIG. 4 is an enlarged portion of the cross-section of FIG. 3.

A shoulder 68 above the central section 56 also provides a series of slots 70. It should be realized that the cross-section of FIG. 4 is taken at a location away from the slot 70 where the top of the pads approach the bottom of the shoulder 68. An upper threaded end 72 of the mandrel 42 receives a connector or nut 74 cooperating with a ring 76 to captivate a series of rigid seal pads 78 to the mandrel 42. As used herein, the term rigid means that the seal pads are made of a rigid material but may be segmented with the segments movable relative to each other, as by pivoting or wobbling.

The upper threaded end 72 provides one or more recesses 80. To insure that the connector 74 does not unthread from the mandrel 42, the connector 74 is deformed, as with a ball peen hammer, into the recesses 80 after it is threaded onto the mandrel 42. As shown best by a comparison of FIGS. 2 and 3, the slots 66 are substantially deeper than the groove 60 and allow formation products to flow between the outside of the mandrel section 56 and the inside of the pads 78. It will also be apparent that the cylindrical section 64 is of smaller outer diameter than the rim 62 because the ring 76 passes over the section 64 and abuts the rim 62.

The seal pads 78 include central sections 82 that are segments of a cylinder and tabs 84 sized and positioned to fit in the slot 70 and in the end of the slot 66 where it exits from the shoulder 64. The overall height of the pads 78 is slightly smaller than the distance between the rim 62 and the shoulder 68 so the pads 78 are capable of slight vertical movement to prevent them from jamming or sticking to the mandrel 42. When assembled, the ring 76 abuts, or nearly abuts, an inclined surface 86 of the pads 78 and the threaded connector 74 approaches a similar inclined surface 88 on the top of the pads 78. It will accordingly be seen that the pads 78 are symmetrical about a horizontal axis through the center of the pads 78 and thus may be installed with either end up, thereby avoiding misassembly of the sleeve 38.

The threaded connector or nut 74 includes threads 90 mating with the threaded section 72 and a thin lower unthreaded skirt 92 which, in the assembled condition, overlies the tabs 84 and part of the inclined section 88 of the pads 78. It will accordingly be seen that the pads 78 are captivated on the mandrel 42 but are loosely mounted to allow lateral or radial movement toward and away from the inner surface of the production string 12.

Construction and operation of the bumper spring 34, decoupler 30, catcher 32 and bypass 36 is disclosed in some detail in U.S. Pat. Nos. 6,209,637 and 6,467,541 to which reference is made for a more complete description. It should also be understood that the decoupler 30 and catcher 32 may be replaced, particularly in the case of a multipiece plunger, with the mechanism shown and described in U.S. Pat. No. 6,719,060 to which reference is made for a more complete description.

Upward movement of the plunger 26 is caused by a pressure differential across the plunger as previously described. Relatively high pressure formation contents pass around the lower cylindrical section 54, through the groove 60, through the slots 66 and into the space between the mandrel central section 56 and the pads 78. This biases the pads 78 radially outwardly toward engagement with the inner surface of the production string 12. Because there is no resilient seal between the upper end of the pads 78 and the mandrel 42, or between the pads 78, formation gas is allowed to escape upwardly around the threaded connector 74. Thus, the pressure differential that propels the plunger 26 upwardly in the well 10 also acts to bias the pads 78 outwardly toward the production string 12 thereby reducing and/or controlling the amount of liquid bypassing the plunger 26. Looked at slightly differently, it is pressure from below that biases the pads 78 toward the production string. Looked at slightly differently, it is pressure in the production string that biases the pads 78 toward the production string. It will be seen that the pads 78 run on a film of liquid on the inside surface of the production string 12 and are thus inherently lubricated.

Using a pressure differential across the pads 78, or across the plunger 26, to bias the rigid pads 78 outwardly toward the inner surface of the production string 12 provides a number of advantages, some of which are relatively subtle. For example, the pressure differential that causes the piston 26 to move upwardly is necessarily greater when the piston 26 is moving upwardly than when the sleeve 38 is moving downwardly. This means that the force biasing the pads 78 outwardly toward the inner wall of the production string 12 is greater when the piston 26 is moving upwardly than when the sleeve 38 is moving downwardly. This has an important advantage because wear caused during downward movement is not only completely useless but is counterproductive because engagement between the pads 78 and the inside of the production string 12 pushes liquid down the production string in the same manner upward movement pushes liquid upwardly. In addition, by reducing wear on the pads 78, longevity is improved.

Similarly, when the sleeve 38 is first released from its position in the well head 20, forces biasing the pads 78 outwardly are at a minimum. This means that the sleeve 38 is very unlikely to stick in the well head 20, in contrast to conventional pad type plungers where the pads are outwardly biased by springs which provide a generally uniform outward force. The most likely place for a conventional pad type plunger to stick is in or immediately below the well head 20 because the conventional plunger has not had sufficient time to build up speed to overcome any unusually high friction force applied by the pads.

Another advantage, particularly in two piece plungers, occurs when there are several tight spots in series in the production string 12 that tend to slow the piston down. When the piston of this invention slows down, there is little or no force biasing the pads 78 outwardly, so there is little or no additional frictional force acting on the plunger 26 that will stop it. In contrast, conventional pad type plungers are more prone to stick in the well during downward movement because of the increased frictional forces between the pads and the production string. This is not a particular problem with one piece plungers because, even if they stick, they will ultimately be dislodged and moved upwardly because of the pressure differential ultimately created in the well. Thus, in the case of one piece plungers, one simply has a short trip that does not remove any liquid. This is not unusual and creates no substantial problem. In the case of two piece plungers, however, if the sleeve doesn't fall to the bottom and unite with the ball, the plunger will never come back up and the plunger must be fished from the well.

There are other potential advantages of the pressure biased seal pads of this invention. Consider a situation where the piston 26 is moving rapidly upwardly. This means there is a substantial pressure differential across the plunger 26 and no substantial liquid load above the plunger 26. This is a time when a maximum outward force is applied to the pads 78 and a maximum sealing force is being generated—exactly what one would want. Consider a situation where there is a large liquid load above the plunger 26 and the plunger 26 has slowed substantially. This might be a time when it is desirable to bypass a little liquid to insure that the piston 26 continues upward movement. Because the piston has slowed, this implies a reduction in the pressure drop across the piston and a reduction in sealing force applied by the pads 78, thereby possibly bypassing a little liquid—exactly what one would want.

Operation of the plunger lift 18 should now be apparent. The ball 40 is first dropped into the well 10. It falls rapidly through a rising stream of produced products onto the bumper 34 which substantially cushions the impact and minimizes damage to the ball 40. When the sleeve 38 is released by the catcher 32, it falls through the well 10 to the bottom. Because there is no substantial pressure differential across the sleeve 38 during downward movement, there is no substantial outward force biasing the pads 78 toward the production string 12 and consequently no substantial wear on the pads 78 during downward movement.

At the bottom of the well 10, the ball 40 and sleeve 38 unite and begin upward movement, pushing any liquid above the piston 26 upwardly. As the piston 26 approaches the well head assembly 20, a slug of liquid passes through the wing valve 24 into a flow line (not shown) leading to a surface treatment facility. The sleeve 38 passes over the decoupler rod 30 which stops upward movement of the ball 40 thereby releasing the ball 40 which drops into the well 10 in the start of another cycle. The sleeve 38 is retained by the catcher 32 because a detent 94 acts on the underside of the sleeve 38 preventing its downward movement for a period of time depending on the requirements of the well 10. If the well 10 needs to be cycled as often as possible, the delay provided by the catcher 32 is only long enough to be sure the ball 40 will reach the bottom of the well 10 before the sleeve 38. In more normal situations, the sleeve 38 will be retained on the catcher 32 so the piston 26 cycles much less often.

Figure 5:
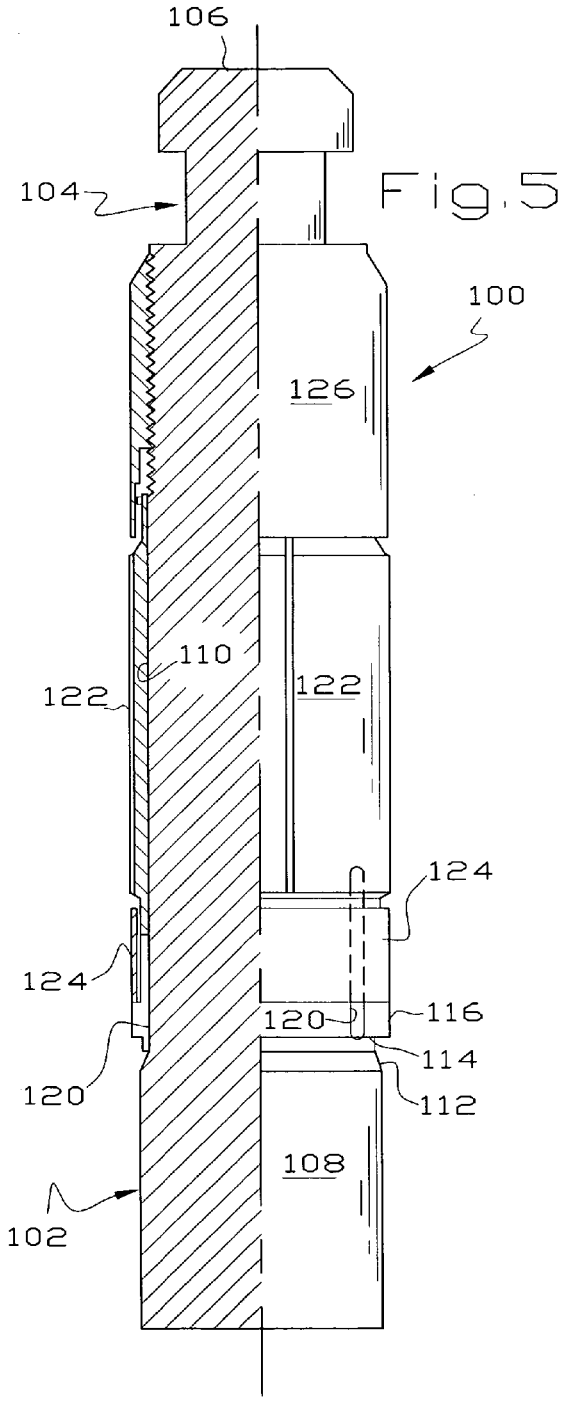
FIG. 5 is a vertical cross-sectional view of a one piece plunger equipped with the pad seals of this invention.

The sealing pads of this invention are also applicable to one piece plungers 100, as shown in FIG. 5. There are two essential differences between the plungers 26, 100: the mandrel 102 is solid rather than having a passage therethrough and a fishing neck 104 is provided on the top of the plunger 100 so it can be fished from a well in the event it becomes stuck.

The mandrel 102 is of one piece and includes an upper end 106 above all other components of the plunger 100 and a lower end 108 below all other components of the plunger 100 so any impacts are taken by the mandrel 102 and not some threadably connected component. As in the plunger 26, this promotes longevity. The mandrel 102 includes the lower end 108 of cylindrical shape of nearly maximum diameter, a central cylindrical section 110, a tapered section 112, a groove 114, and a maximum diameter rim 116 providing a transition between the cylindrical sections 108, 110. A series of slots 120 extend from the groove 114 to a location beneath a series of rigid pads 122 providing tabs (not shown) received in notches (not shown) analogous to the tabs 84 and notches 66, 70 in the sleeve 38. A ring 124 cooperates with a threaded connection 126 to captivate the rigid pads 122 and allow them considerable room to move radially into engagement with the inside of the production string and axially to prevent or minimize sticking. It will be evident that the seal pads 122 operate in the same manner as the seal pads 82 and accordingly provide many advantages for the plunger 100.

As in the case of the sleeve 38, the rim 116 is of maximum diameter and is slightly larger than the lower cylindrical section 108 and preferably is of the same diameter as the upper section 126. The pads 122 are of smaller diameter than the rim 116 when retracted and larger than the rim 116 when expanded.

It will be evident to those skilled in the art that the one piece plunger 100 operates, other than the pads 122, in a conventional manner. The above ground installation of FIG. 1 is operative with the plunger 100 except that the decoupler 30 has to be removed.

Figure 6:
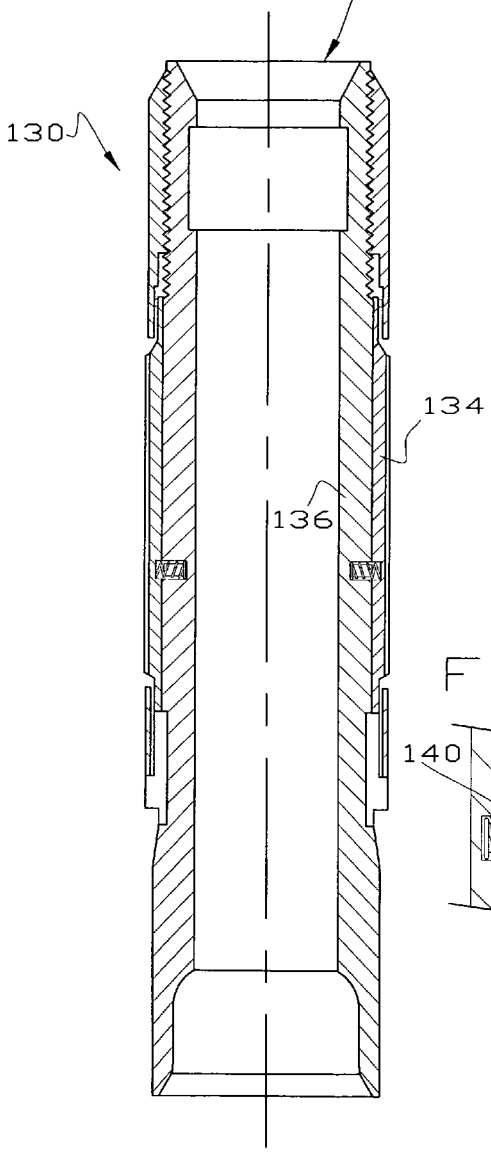
FIG. 6 is a vertical cross-sectional view of another embodiment of this invention.
Figure 7:
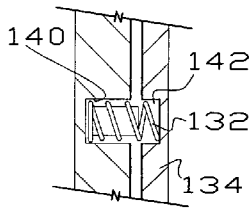
FIG. 7 is an enlarged portion of the cross-section of FIG. 6.

Referring to FIGS. 6-7, another embodiment of this invention, comprising a sleeve 130 of a two piece plunger, is illustrated although the principles equally apply to a one piece plunger. The sleeve 130 differs from the sleeve 38 only in the provision of springs 132 which assist the pressure differential to bias the pads 134 outwardly toward the inside of the production string 12. To this end, a central cylindrical section 136 of the mandrel 138 provides a recess 140 and the pads 134 each provide an aligned recess 142 which cooperate to receive and retain the spring 132. Although the spring 132 is illustrated as a helical spring, other spring configurations, such as a leaf spring are similarly operable.

It might be thought that the seal pads 134 operate in much the same manner as spring biased prior art pads, particularly since it might be thought that pressure from below in a prior art spring biased plunger pad inherently gets behind the pad thereby biasing it toward the inside of the production string. There are two features of the sleeve 130 which suggest that this is not the case. First, the springs 132 are not nearly so robust as the prior art springs and accordingly do not generate the same outwardly biasing force as prior art springs. Thus, the purpose and effect of the springs 132 is to be sure that the pads 134 move away from the cylindrical mandrel section 136 to allow pressure from below to get behind the pads 134.

Second, the springs 132 and the prior art springs operate in compression, meaning that when the springs are no longer in compression, no force is applied to the seal pads. In the case of the springs 132, they are no longer in compression when the pads 134 reach the inside of the production string or when the pads 134 reach their limit of radially outward movement. In other words, the maximum radial movement of the pads 134 is greater than the maximum radial movement of the springs 132.

Figure 8:
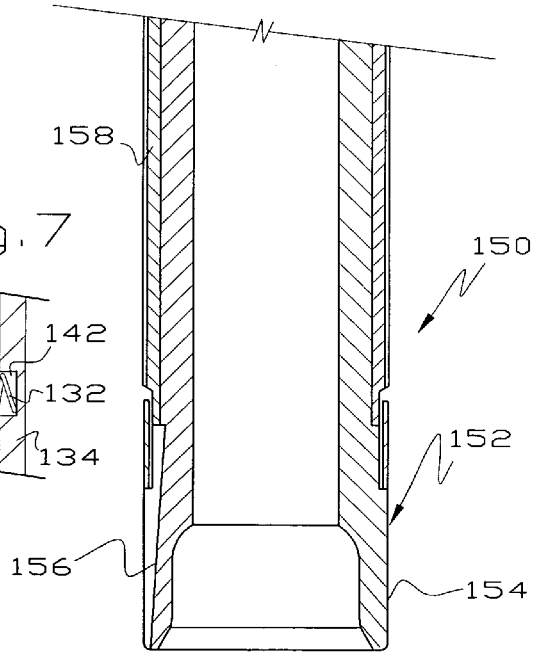
FIG. 8 is a partial vertical cross-sectional view of another embodiment of this invention.

Referring to FIG. 8, there is illustrated another embodiment of this invention, comprising a sleeve 150 of a two piece plunger, is illustrated although the principals equally apply to a one piece plunger. In the embodiments of FIGS. 1-7, the maximum diameter rim is well above the bottom of the mandrel, meaning that the lower cylindrical section 54, in the embodiment of FIGS. 1-4, for example, is relatively large. This is of importance because the section 54 is relatively massive and thereby capable of withstanding prolonged beating on the lower bumper spring 34. Although this feature is of importance, it is not essential as shown in the sleeve 150 where the maximum diameter of the mandrel 152 is located on the lower cylindrical section 154.

The cross-section of FIG. 8 is taken at a location where one of the slots 156 extending upwardly and under the seal pads 158 is exposed on the left side of FIG. 8 but the right side of FIG. 8 is located away from its adjacent slot 156. Thus, in the sleeve 150, the slots 156 extend to the lowermost end of the mandrel 152. This may weaken the lower end slightly, but there are many situations where the sleeve 150 is eminently suitable.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A plunger lift for a well producing through a production string communicating with a hydrocarbon formation, comprising a free piston movable upwardly in the well in response to a pressure differential across the piston and having at least one rigid pad carried by the piston and movable toward an inside wall of the production string for reducing bypass of gas and liquid around the piston, the rigid pad being biased toward the production string by a pressure differential across the pad, the pressure differential across the pad being the only force biasing the pad toward the production string, the piston comprising a central one-piece mandrel having a lower end lower than any other component of the piston and an upper end higher than any other component of the piston so that all impact forces applied to the piston are applied to the one-piece mandrel.

2. The plunger lift of claim 1 wherein the free piston includes a sleeve having an axial passage therethrough and a ball cooperating with the sleeve for uniting at a location in the well adjacent a collection of formation liquid and moving upwardly together to push liquid above the piston upwardly.

3. The plunger lift of claim 1 wherein the free piston includes a solid mandrel having no axial passage therethrough.

4. The plunger lift of claim 1 wherein the pressure differential moving the free piston upwardly in the well is essentially the same pressure differential that moves the rigid pad toward the production string.

5. The plunger lift of claim 1 wherein the at least one pad is of one piece and is rigid from an upper end thereof to a lower end thereof.

6. The plunger lift of claim 1 wherein the at least one pad comprises at least two rigid segments movable relative to each other.

7. A plunger lift for a well producing through a production string communicating with a hydrocarbon formation, comprising a free piston propelled upwardly by a pressure differential across the piston and having at least one rigid pad carried by the piston and movable toward an inside wall of the production string for reducing bypass of gas and liquid around the piston, the pad being biased toward the production string by a force proportional to the rate of upward movement in the well, the force being exclusively created by the pressure differential, the piston comprising a central one-piece mandrel having a lower end lower than any other component of the piston and an upper end higher than any other component of the piston so that all impact forces applied to the piston are applied to the one-piece mandrel.

8. A plunger lift for a well producing through a production string communicating with a hydrocarbon formation, comprising a free piston movable upwardly in the well in response to a pressure differential across the piston and having at least one rigid pad carried by the piston and movable toward an inside wall of the production string for reducing bypass of gas and liquid around the piston, and a spring biasing the pad away from the mandrel, the pad having a first predetermined limit of radial movement and the spring has a second predetermined limit of radial movement during upward movement of the free piston, the first limit of movement being greater than the second limit of movement so the spring does not bias the pad against an inside surface of the production string during upward movement of the free piston, the rigid pad being biased toward the production string by a pressure differential across the pad.

9. The plunger lift of claim 8 wherein the spring has a third predetermined limit of radial movement during downward movement of the free piston, the first limit of movement being greater than the third limit of movement so the spring does not bias the pad against the inside surface of the production string during downward movement of the free piston.

10. The plunger lift of claim 9 wherein the third predetermined limit of radial movement of the spring is of equal magnitude to the second predetermined limit of movement of the spring.

11. The plunger lift of claim 8 wherein the piston comprises a central one-piece mandrel having a lower end lower than any other component of the piston and an upper end higher than any other component of the piston so that all impact forces applied to the piston are applied to the one-piece mandrel.

* * * * *